US006427609B1

(12) United States Patent
Grant

(10) Patent No.: US 6,427,609 B1
(45) Date of Patent: Aug. 6, 2002

(54) COLLAPSIBLE VOTING BOOTH

(76) Inventor: Walter S. Grant, 24512 Michigan Ave., Dearborn, MI (US) 48124

( * ) Notice: Subject to any disclaimer, the term of this patent is extended or adjusted under 35 U.S.C. 154(b) by 0 days.

(21) Appl. No.: 09/761,563

(22) Filed: Jan. 18, 2001

(51) Int. Cl.[7] ..... A47B 57/00
(52) U.S. Cl. ..... 108/60
(58) Field of Search ..... 108/60, 61, 180, 108/157.14, 165; 211/200, 201, 184

(56) References Cited

U.S. PATENT DOCUMENTS 2,908,400 A * 10/1959 Richter
3,069,216 A * 12/1962 Vaeth
3,326,147 A * 6/1967 Toney
3,339,502 A * 9/1967 Fyffe
3,538,976 A * 11/1970 Gilbert ..... 108/60 X
D219,519 S * 12/1970 Gianfagna
3,550,540 A 12/1970 Albrecht et al.
3,629,960 A * 12/1971 Roush ..... 108/60 X
3,636,890 A 1/1972 Huff
3,636,960 A * 1/1972 Huff ..... 108/60
3,927,481 A 12/1975 Safranek
5,702,011 A * 12/1997 Carroll ..... 108/180 X

* cited by examiner

*Primary Examiner*—Jose V. Chen
(74) *Attorney, Agent, or Firm*—Charles W. Chandler

(57) ABSTRACT

A portable, collapsible voting booth forming a plurality of individual voting compartments on a table top to screen voters from observation of their votes from other persons present at the polling place. The voting booth includes a rectangular center panel having hooks which connect centrally to mating slots in a pair of end panels at a right angle to form an H-shape when viewed from above the table. Respective individual voting compartments are formed on opposite sides of the center panel between the end panels. The panels each include a centrally disposed, rectangular handle cutout adjacent an upper edge of each panel for carrying multiple panels in-hand. An additional center panel and connected end panel can be attached to each end panel using the second slot of the pair to produce additional pairs of side-by-side voting compartments.

19 Claims, 3 Drawing Sheets

COLLAPSIBLE VOTING BOOTH

BACKGROUND OF THE INVENTION

1. Field

Figure 1:
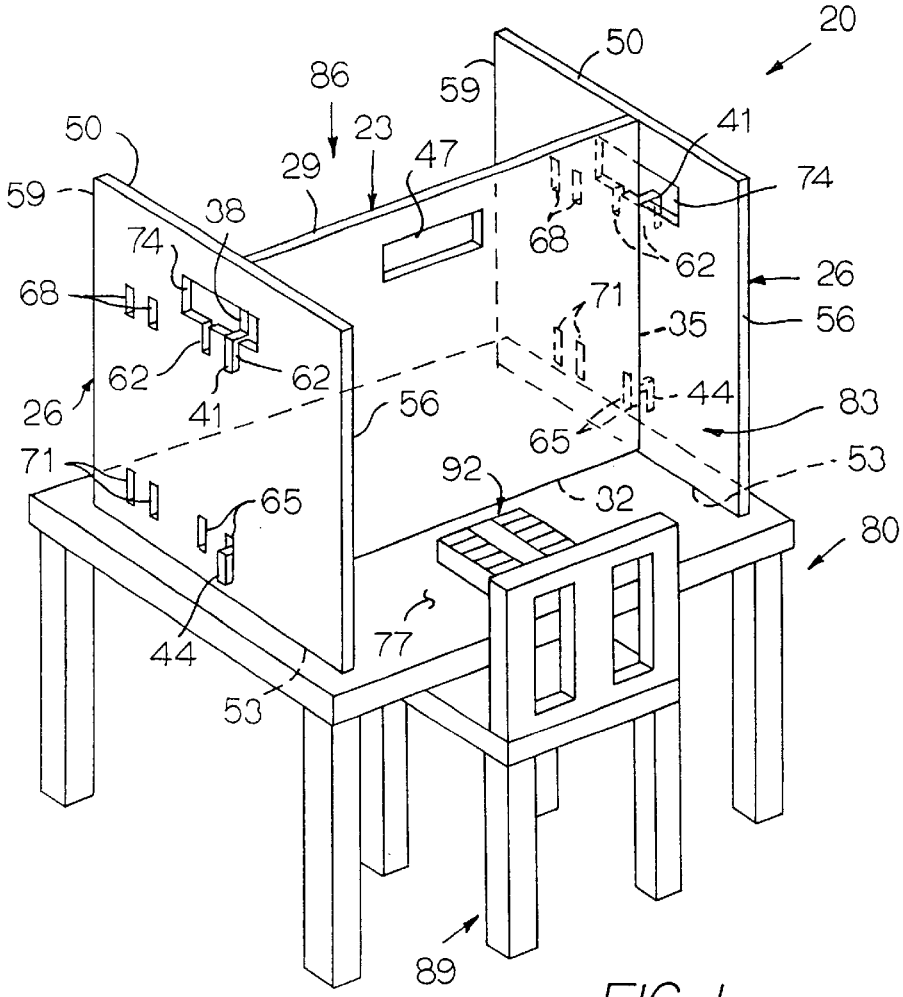

The invention relates to collapsible partitions for forming individual compartments such as for voting, and more particularly to partitions used for voting which are useable in conjunction with standard tables.

2. State of the Art

Voting booths are used to allow voters privacy during elections to vote their conscience for candidates and on the various issues which must be decided. However, since voting is a periodic event, rather than a continual daily process, there is a need for voting booths which are collapsible for more compact storage during periods of non-use, and which are portable.

One such device is collapsible voting compartments disclosed in U.S. Pat. No. 3,550,540 issued to Albrecht et al. The device is a folding table on top of which are assembled a plurality of U-shaped partition panels having tabs which fit into mating slots in the table top to form six individual voting compartments, three on each side of the table. A plurality of lighting fixtures clamp to the upper edges of the panels to light the voting compartments and to clamp the individual panels together. Paper ballots can be filled out on the table top, or a plurality of punch card voting devices can be placed thereon for voting. The light fixtures and panels are removed following voting, the table legs collapsed, the panels folded flat, and the panels are stored within the collapsed table along with the lighting fixtures.

While the device of Albrecht et al. solves the storage and portability problem to a certain degree, the device is relatively complex and thus somewhat expensive, and heavy to carry. There is a need for a less costly, lighter weight device which is useable with standard tables already available at many business locations, such as those used for voting, wherein the devices can be assembled on the tables during times of voting, and stored so the tables can be used for conventional work during non-voting periods.

While applicant is unaware of any such devices specifically designed for voting, there are several such devices designed for use in the classroom setting. U.S. Pat. No. 3,636,890 issued to Huff discloses a portable carrel for use on a standard rectangular table. The portable carrel includes a folding panel, having four spaced slots, which extend vertically downwardly half the height of the panel. The portable carrel further includes four transversely crossing panels each having a central slot which extends vertically upwardly half the height of the panel. The panels stand on edge and interconnect at the slots to form six individual voting compartments, three on each side of the table, with downwardly extending protrusions at each end of the panels overhanging the table top to maintain the panels in position thereon.

U.S. Pat. No. 3,927,481 issued to Sanfranek discloses a portable collapsible partition also for use on top of a standard rectangular table, comprising of six end panels and a longer center panel. An edge of three of the end panels is hingedly connected to each end of the center panel. The partition unfolds from a flat configuration to form six individual private compartments when placed edgewise on the table. Seven suction devices, one connected to a lower edge of each panel, retain the panels attached to the table top during use. A pair of separators comprising a platform-like top and a downwardly dependent, elongate rectangular locking section having a pair of crossing longitudinally disposed slots, fits over upper edges of the clusters to maintain the panels in the unfolded position. The separators can include communication media accessible through individual headphones.

While the devices of Huff and Sanfranek are less costly, useable with standard tables, and store so the tables can be used for conventional work during periods of non-voting, there are still some drawbacks to each. The portable carrel of Huff is rather unwieldy in the collapsed state with no apparent way to easily carry the individual panels. The design of the carrel is not flexible, forming six individual private compartments rather than allowing only one, two, or more compartments to be formed, and consequently must always be used only on longer tables. Likewise, the portable collapsible partition of Sanfranek is rather unwieldy in the folded state with no means for keeping the individual panels together. The design of the partition is not flexible, forming six individual private compartments rather than allowing only one, two, or more compartments to be formed, and consequently must also only be used on longer tables. Furthermore, the partition requires the use of two separators and seven suction devices which must also be stored during periods of non-use.

SUMMARY OF THE INVENTION

An object of the present invention is to provide a collapsible voting booth which is inexpensive and which can be used on the standard tables, already readily available at many polling places.

Another object of the invention is to provide a collapsible voting booth, which is easily assembled and disassembled to a compact, flat configuration.

Another object of the invention is to provide a collapsible voting booth, which is of lightweight yet sturdy construction.

A still further object of the invention is to provide a voting booth, which can be easily carried, providing handle cutouts, which align when the panels are transported for single hand carrying.

With these and other related objects in mind, the present invention comprises a portable, collapsible voting booth for forming individual voting compartments on a table top, providing privacy while casting votes during an election. The voting booth includes a rectangular center panel, which is placed edgewise on the top of a standard table, and a pair of rectangular end panels, which are also placed edgewise thereon. The end panels connect at a right angle to opposite side edges of the center panel to form an H-shape, as viewed from above. Opposing individual voting compartments of about equal size are formed on opposite sides of the center panel between the end panels.

The end panels connect to the center panel by means of two pairs of vertically spaced, integral hooks, one pair extending from each side edge of the center panel, and two vertical aligned central slots is the end panels. The slots mate with the hooks. If the option of a single, larger size voting compartment is desired, each end panel can further include a set of two additional slots, disposed adjacent one side edge of each end panel. The additional slots permit the center panel to be connected in a more rearwardly located position on the respective end panels, to form a generally U-shape as viewed from above, with a single individual voting compartment of larger size formed only on one side of the center panel.

Preferably, the center panel and each end panel include a handle cutout, which is centrally located on each panel, for balanced weight distribution while carrying the respective panels. The center panel and the end panels can then be transported together.

The voting booth can be extended to provide multiple, side-by-side individual voting compartments by providing spaced pairs of slots, rather than individual slots. An additional center panel can then be attached to each end panel together with an additional end panel to form an additional voting compartment.

THE DRAWINGS

Figure 2:
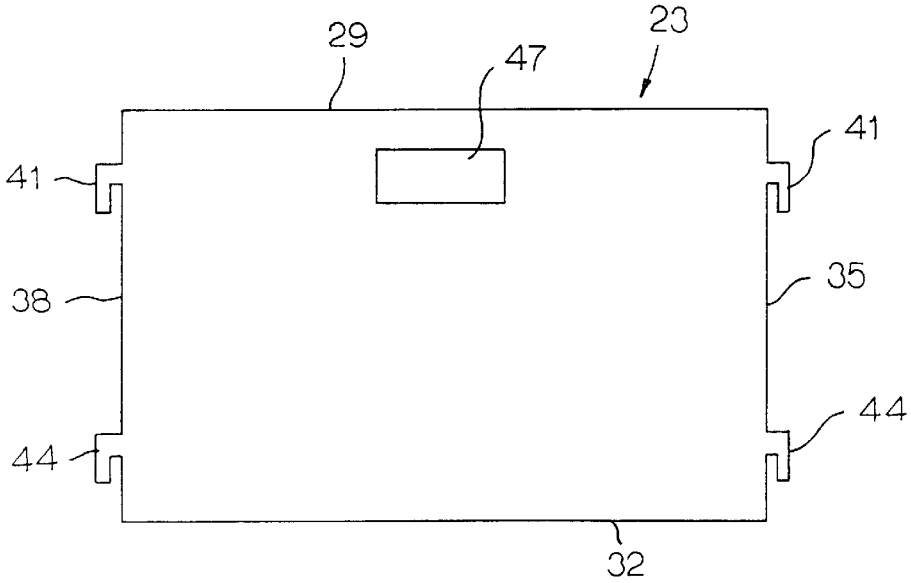
Figure 3:
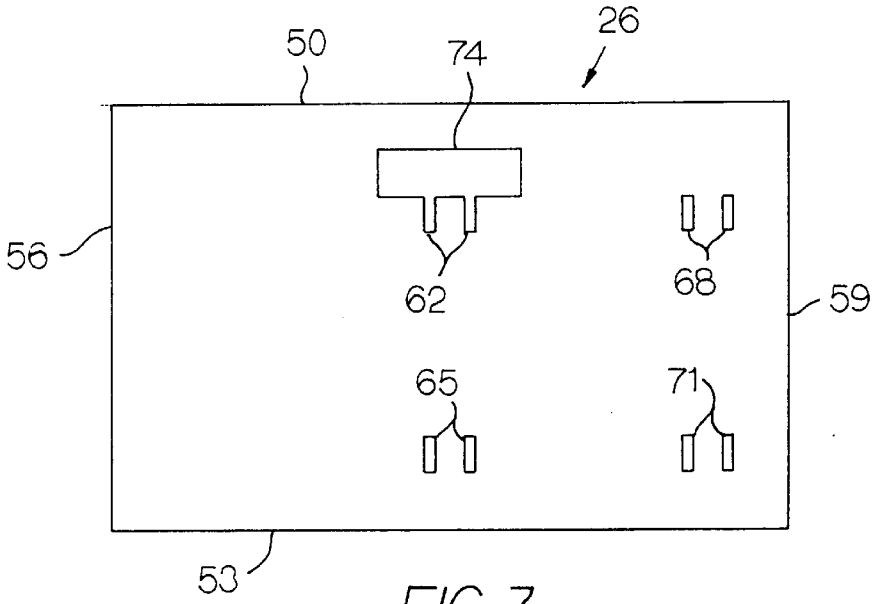
Figure 5:
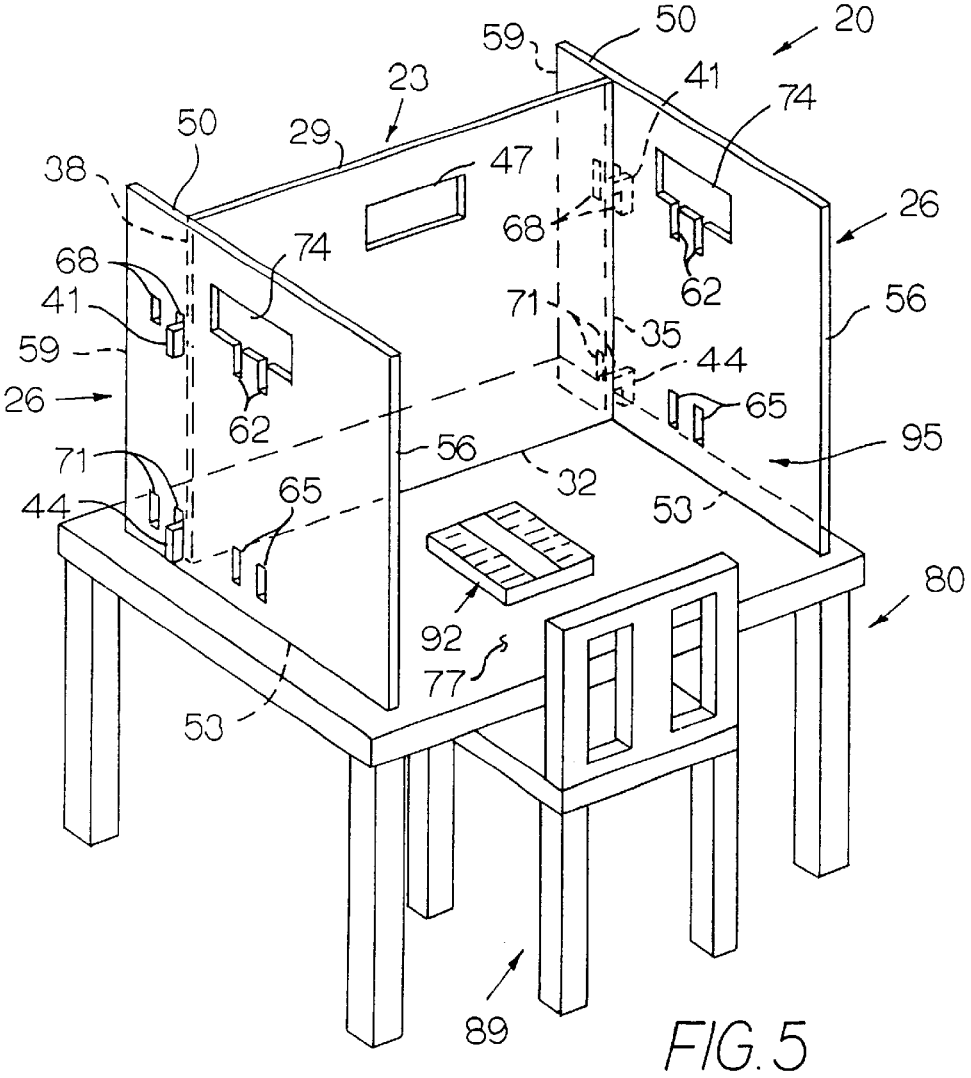
Figure 4:
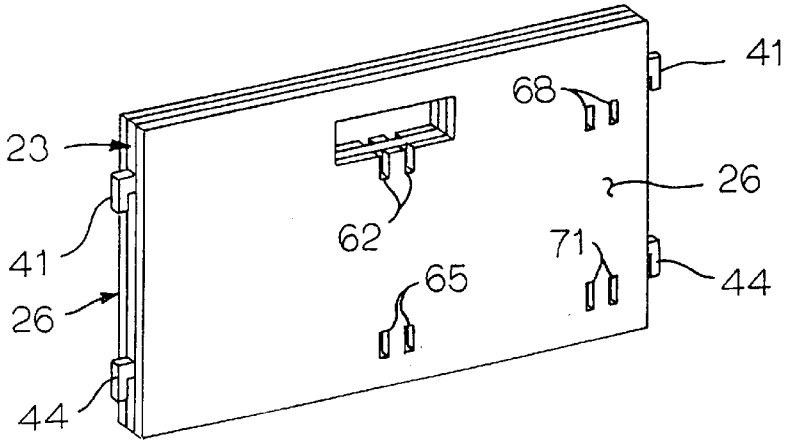
Figure 6:
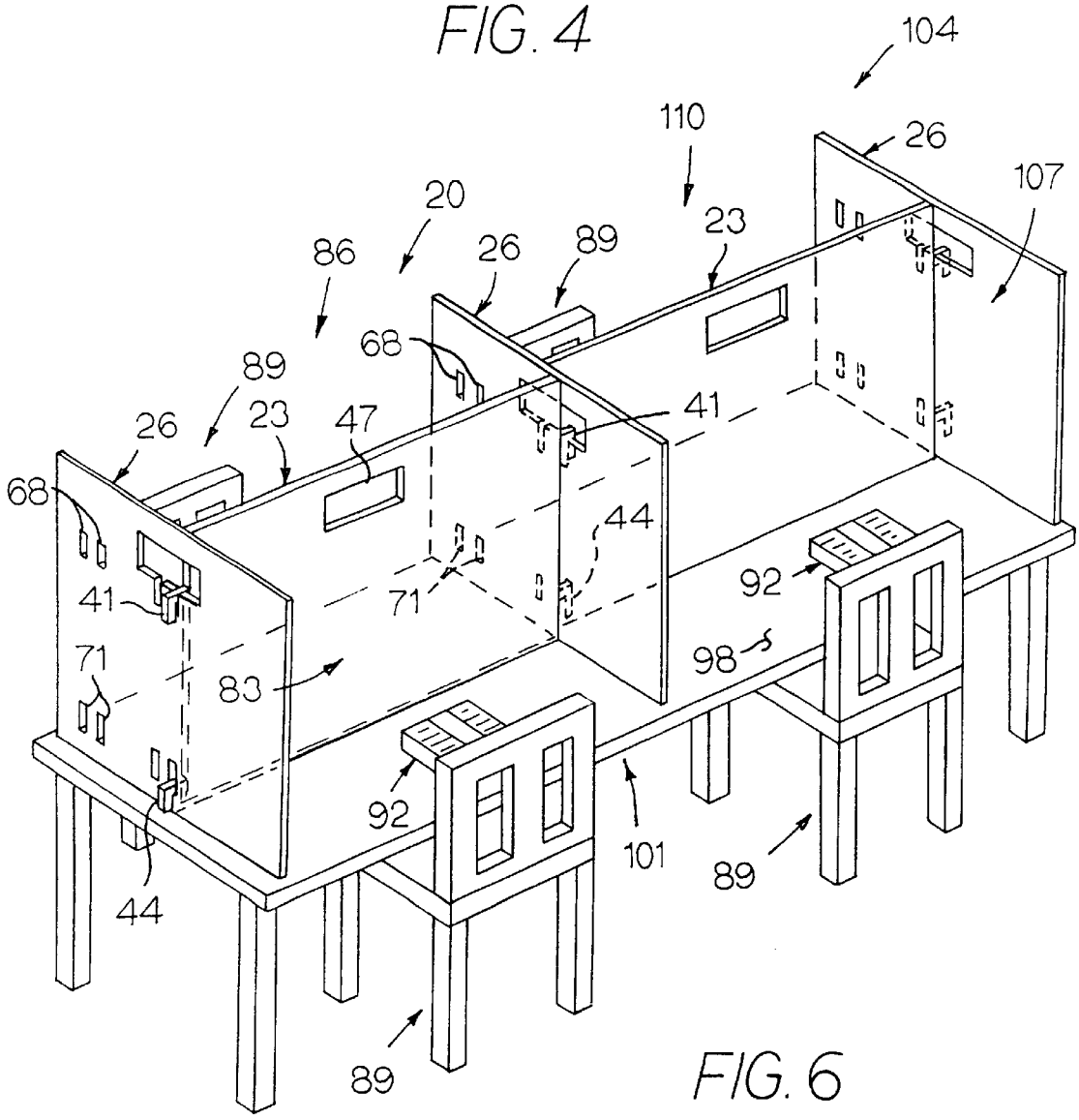

The best mode presently contemplated for carrying out the invention is illustrated in the accompanying drawings, in which:

FIG. 1 is a perspective view of a collapsible voting booth constructed according to the invention, erected on a rectangular table, the center panel being located position between the end panels to form two opposing individual voting compartments;

FIG. 2, a front elevational view of the center panel showing the pairs of hooks extending from the side edges thereof;

FIG. 3, a front elevational view of one end panel showing the central and rearward located upper and lower pairs of slots;

FIG. 4, a perspective view of the collapsible voting booth as disassembled, with the center panel and the two end panels positioned for carrying in-hand;

FIG. 5, a perspective view of the collapsible voting booth corresponding to FIG. 1, wherein the center panel is in an alternate, rearward position to form a single, larger individual voting compartment; and FIG. 6, a perspective view of the collapsible voting booth as extended for use on a larger, table, wherein an additional center panel is connected to one of the end panels to form an additional pair of individual voting compartments.

DETAILED DESCRIPTION OF THE ILLUSTRATED EMBODIMENTS

A portable collapsible voting booth according to the invention is shown in FIGS. 1–5. Voting booth 20 comprises a center panel 23 and a pair of end panels 26. Center panel 23 includes top and bottom edges 29 and 32, and side edges 35 and 38. Two integral, downwardly opening upper and lower hooks 41 and 44, extend from opposite side edges 35 and 38, coplanar with center panel 23. A rectangular handle cutout 47 for gripping center panel 23 in-hand is centrally located adjacent top edge 29 for balanced weight distribution while carrying center panel 23.

End panels 26 each include top and bottom edges 50 and 53, and side edges 56 and 59. Two centrally located pairs of upper and lower vertically aligned slots 62 and 65, and a rearwardly located pair of upper and lower vertically aligned slots 68 and 71 extend through end panels 26. Slots 62 and 65, and 68 and 71 correspond with upper and lower hooks 41 and 44. A rectangular handle cutout 74 for gripping end panels 26 in-hand is centrally located adjacent top edge 50 for balanced weight distribution while carrying each end panel 26. Handle cutout 74 overlaps upper slots 62 for ease in inserting upper hooks 41.

End panels 26 assemble to center panel 23 on a table top 77 of a table 80 by inserting upper and lower hooks 41 and 44 into the desired pairs of slots 62 and 65, or 68 and 71, and lowering center panel 23 relative to end panels 26. This locks upper and lower hooks 41 and 44 in their respective slots 62 and 65, or 68 and 71, to removably connect center panel 23 to end panels 26 in an assembled condition. Bottom edges 32 and 53 are coplanar, to form two opposed voting compartments 83 and 86 (FIG. 1).

Paper ballots (not shown) can then be filled out on table top 77 by a person (not shown) sitting in a chair 89, or punch type voting machines 92 can be utilized for voting. After the voting process is completed, end panels 26 are released from center panel 23 by raising center panel 23 relative to end panels 26, releasing upper and lower hooks 41 and 44 from the respective slots 62 and 65, or 68 and 71. Center panel 23 can then be sandwiched between the end panels 26 with the respective handle cutouts 47 and 74 aligned for easy gripping in-hand for transport (FIG. 4).

Center panel 23 is preferably about twenty-four inches high by about twenty-eight and one-half inches wide. End panels 26 are preferably each about twenty-four inches high by about thirty inches wide, to provide a comfortably sized individual voting compartment and also fit standard table sizes. Center panel 23 and end panels 26 are preferably made of polyvinyl chloride (PVC) foam-filled board of a thickness of about one-quarter inch. Center panel 23 is preferably of a different color than end panels 26, such as yellow and blue, respectively, to aid in differentiating the panels for ease of assembly and disassembly.

As shown in FIG. 5, voting booth 20 can be erected in an alternative form wherein center panel 23 is in a more rearward position, with upper and lower hooks 41 and 44 in one of the rearwardly located pairs of upper and lower slots 68 and 71, to form a single larger voting compartment 95. This configuration might be preferable where the number of voters is relatively small, such that the two opposed voting compartments 83 and 86 are not needed, or to accommodate larger sizes of voting machines 92.

As shown in FIG. 6 voting booth 20 can be expanded to simultaneously accommodate additional voters by adding an additional center panel 23 and end panel 26 on the top 98 of a larger table 101. This expanded voting booth 104 includes multiple pairs of opposed voting compartments 83 and 86, and 107 and 110 formed adjacent one another. In such a configuration, upper and lower hooks 41 and 44 of the additional center panel 23 extend through the other of the two centrally located pairs of unoccupied aligned slots 62 and 65. The additional end panel 26 is connected to the additional center panel 23 in the same manner as end panel 26. As with voting booth 20, the centrally and rearwardly located pairs of upper and lower vertically aligned slots 62 and 65, and 68 and 71 also allow a pair of larger voting compartments (not shown) of the size shown in FIG. 5 to be formed. After the voting process is completed, the three end panels 26 can be released from center panels 23, and center panels 23 sandwiched between end panels 26 with the respective handle cutouts 47 and 74 aligned for easy gripping in-hand for transport.

Many variations of the voting booth of the invention are possible while staying within the same inventive concept. For example, the connectors can comprise other than respective hooks and mating slots, such as respective elongate tongues which are integral with or affixed to the side edges of the center panel, and mating elongate flanges of C-shaped cross-section affixed to the respective end panels. The tongues and plates are vertically oriented for assembly together by sliding the respective tongues into the mating flanges. Likewise, various other connectors can also be used which provide a similar connecting function. The panels can be made of Styrofoam, blow-molded or solid plastic, or other such material manufactured by the various identical processes.

Whereas this invention is illustrated and described with reference to embodiments presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A portable, collapsible voting booth for forming at least one individual voting compartment when assembled on a table top, comprising:

a center panel having respective top and bottom edges, and a pair of side edges each having at least one connector;

a pair of end panels each having respective top and bottom edges, a pair of side edges, and at least one connector disposed between said side edges so as to correspond with said connector of said center panel;

wherein said connectors of said center panel and said end panels are releasably interlockable to connect said end panels to said ends of said center panel at a generally right angle with said bottom edges of the respective panels coplanar for placement on a table top, and with the respective side edges of said end panels being laterally evenly disposed;

wherein the center panel and each end panel include a handle cutout for gripping in-hand, said handle cutouts being generally centrally located on each panel adjacent the respective top edge thereof for balanced weight distribution while carrying the respective panels, said center and end panels being of about the same size, and said handle cutouts being disposed such that when said center panel and said end panels are juxtaposed with the respective edges thereof generally aligned, said handle cutouts are aligned for carrying all three of said panels together in-hand.

2. The voting booth of claim 1, wherein the connectors of the center panel and end panels each comprise a mating connector chosen from the group consisting of hooks and slots.

3. The voting booth of claim 2, wherein the connectors of the center panel comprise hooks, at least one of which extends from each side edge, generally coplanar with said center panel, and the connectors of the end panels comprise slots, at least one slot being disposed through each respective end panel.

4. The voting booth of claim 3, wherein the slots extend vertically and the hooks open downwardly to engage said slots.

5. The voting booth of claim 4, wherein the slots are centrally disposed between the side edges of the end panels to form a pair of individual voting compartments of about the same size on opposite sides of the center panel.

6. The voting booth of claim 5, wherein the respective slots each comprise a pair of slots in a closely spaced, parallel relationship to allow connecting thereto of an additional center panel with an additional end panel, opposite the center panel, to form at least one additional individual voting compartment adjacent said end panel.

7. The voting booth of claim 5, wherein there are at least two slots through each end panel in a spaced, parallel relationship, one of said slots being centrally disposed between the side edges of the respective end panels and one being disposed adjacent a side edge of the respective end panels, to selectively form a pair of individual voting compartments of about the same size on opposite sides of the center panel and a single individual voting compartment of a larger size on one side of said center panel.

8. The voting booth of claim 7, wherein the respective slots through the end panels each comprise a pair of slots in a closely spaced, parallel relationship to facilitate connecting an additional center panel with an additional end panel thereto, opposite the center panel, to form at least one additional individual voting compartment adjacent said end panel.

9. The voting booth of claim 1, wherein the center panel is of a different color than the end panels.

10. The voting booth of claims 1, wherein the center panel and the end panels are made of polyvinyl chloride (PVC) foam-filled board.

11. The voting booth of claim 1, wherein the center panel and the end panels are made of cardboard.

12. The voting booth of claim 1, wherein there are at least two aligned connectors on the center panel and each end panel, each respective connector comprising a mating connector chosen from the group consisting of hooks and slots.

13. The voting booth of claim 2, wherein the connectors of the center panel comprise hooks, at least one of which extends from each side edge generally coplanar with said center panel, and the connectors of the end panels comprise slots, at least one slot being disposed through each respective end panel.

14. The voting booth of claim 3, wherein the slots extend vertically and the hooks open downwardly to engage said slots.

15. The voting booth of claim 4, wherein the slots are centrally disposed between the side edges of the end panels to form a pair of individual voting compartments of about the same size on opposite sides of the center panel.

16. The voting booth of claim 15, wherein the respective slots each comprise a pair of slots in a closely spaced, parallel relationship to allow connecting thereto of an additional center panel with an additional end panel, opposite the center panel, to form at least one additional individual voting compartment adjacent said end panel.

17. The voting booth of claim 15, wherein there are at least two slots through each end panel in a spaced, parallel relationship, one of said slots being centrally disposed between the side edges of the respective end panels and one being disposed adjacent a side edge of the respective end panels, to selectively form a pair of individual voting compartments of about the same size on opposite sides of the center panel and a single individual voting compartment of a larger size on one side of said center panel.

18. The voting booth of claim 17, wherein the respective slots through the end panels each comprise a pair of slots in a closely spaced, parallel relationship to facilitate connecting an additional center panel with an additional end panel thereto, opposite the center panel, to form at least one additional individual voting compartment adjacent said end panel.

19. A portable, collapsible voting booth for forming at least one individual voting compartment when assembled on a table top, comprising:

a center panel having respective top and bottom edges, and a pair of side edges each having at least one connector;

a pair of end panels each having respective top and bottom edges, a pair of side edges, and at least one connector disposed between said side edges so as to correspond with said connector of said center panel; and wherein said connectors of said center panel and said end panels are releasably interlockable to connect said end panels to said ends of said center panel at a generally right angle with said bottom edges of the respective panels coplanar for placement on a table top, and with the respective side edges of said end panels being laterally evenly disposed;

wherein there are at least two aligned connectors on the center panel and each end panel, each respective connector comprising a mating connector chosen from the group consisting of hooks and slots; and wherein the center panel and each end panel include a handle cutout for gripping in-hand, said handle cutouts being generally centrally located on each panel adjacent the respective top edge thereof for balanced weight distribution while carrying the respective panels.

* * * * *